US008051997B2

(12) United States Patent
Buckley

(10) Patent No.: US 8,051,997 B2
(45) Date of Patent: Nov. 8, 2011

(54) DAILY WATER BOTTLE CONSUMPTION SYSTEM

(76) Inventor: Michael Buckley, Seattle, WA (US)

( * ) Notice: Subject to any disclaimer, the term of this patent is extended or adjusted under 35 U.S.C. 154(b) by 963 days.

(21) Appl. No.: 11/975,189

(22) Filed: Oct. 16, 2007

(65) Prior Publication Data

US 2008/0087624 A1 Apr. 17, 2008

Related U.S. Application Data

(60) Provisional application No. 60/852,310, filed on Oct. 16, 2006.

(51) Int. Cl.
*B65D 41/62* (2006.01)
*B65D 51/24* (2006.01)
*B65D 47/04* (2006.01)

(52) U.S. Cl. ..... 215/230; 215/258; 215/306; 215/365; 215/387

(58) Field of Classification Search ..... 215/230, 215/258, 306, 335, 387, 365; 220/254.8, 220/259.4, 717, 713
See application file for complete search history.

(56) References Cited

U.S. PATENT DOCUMENTS 4,877,119 A 10/1989 Hosking
5,082,129 A * 1/1992 Kramer ..... 215/221
5,358,117 A * 10/1994 Adams ..... 206/534
5,577,335 A * 11/1996 Tucker ..... 40/311
5,607,078 A 3/1997 Nordberg et al.
5,644,298 A 7/1997 Brooks et al.
5,845,777 A 12/1998 Najmi
5,896,990 A 4/1999 Barzana
5,919,365 A * 7/1999 Collette ..... 210/419
5,984,122 A * 11/1999 Barker et al. ..... 215/230
6,523,688 B1 * 2/2003 Palmieri ..... 206/459.1
7,000,791 B2 * 2/2006 Miller ..... 215/230
2003/0222045 A1 * 12/2003 Shane ..... 215/230
2003/0230575 A1 * 12/2003 Laurent ..... 220/254.8
2004/0206295 A1 * 10/2004 Zamjahn ..... 116/309
2007/0187282 A1 * 8/2007 Seijas ..... 206/534
2008/0041809 A1 * 2/2008 Shek ..... 215/315

* cited by examiner

*Primary Examiner* — Mickey Yu
*Assistant Examiner* — Niki Eloshway
(74) *Attorney, Agent, or Firm* — Christensen O'Connor Johnson Kindness PLLC

(57) ABSTRACT

A daily water bottle consumption system that includes a bottle with a threaded neck and a top opening. Attached to the neck is an intermediate cap with internal threads that selectively connect to the external threads on the bottle's neck. Formed on the intermediate cap is a threaded spout to which a removable lid is attached. The lid includes a cylindrical shaped lid body with a first recessed cavity in which a rotating turn dial is disposed. Disposed between the first recessed cavity and the turn dial is a snap ring that enables the turn dial to be manually turned and click into one of a plurality of coded positions. Formed on the turn dial is a handle which the user grasps and rotates to indicate the number of times the bottle has been filled with a desired liquid in a 24 hour period.

9 Claims, 8 Drawing Sheets

DAILY WATER BOTTLE CONSUMPTION SYSTEM

This is a utility patent application which claims benefit of U.S. Provisional Application No. 60/852,310 filed on Oct. 16, 2006.

BACKGROUND OF THE INVENTION

1. Field of the Invention

This invention relates to devices used to track an individual's consumption of water, and more particularly to such devices that allow an individual to track the amount of water daily consumed from a water bottle.

2. Description of the Related Art

It is generally recommended that the average adult drink approximately 60 to 100 fluid ounces of water every day. While plastic water bottles are very popular today, many adults fail to drink approximately 60 to 100 fluid ounces of water every day because there isn't a convenient method for monitoring and recording the total quantity of water consumed in the course of a given day.

Ideally, the device for monitoring and recording the quantity of water consumed by an individual during a 24 hour period should be attached directly on the water bottle so that the amount consumed can be easily recorded and not lost or stolen. The device should also be relatively small so that it does not interfere with the use or change the appearance of the water bottle. Also, the device should be designed so that the recorded amount cannot be accidentally altered during the 24 hour period under normal use conditions.

SUMMARY OF THE INVENTION

It is an object of the present invention to provide a system for monitoring and tracking daily consumption of a desired liquid, such as water, thus facilitating optimal personal daily hydration.

It is another object of the present invention to provide such a system that allows the user to easily track the number of times the volume of liquid in the bottle is consumed in a 24 hour period, thereby enabling the user to easily determine the total volume of liquid consumed.

It is another object of the present invention to provide such a system that allows the user to easily track the number of times the volume of liquid in the bottle is consumed in a 24 hr. period, thereby enabling the user to easily determine the total volume of liquid consumed.

It is another object of the present invention to provide such a system in which the total number of bottles consumed is recorded on the lid attached to the bottle and cannot be accidentally altered during normal use.

These and other objects are met by the daily water bottle consumption system disclosed herein that includes a transparent or semi-opaque bottle of a known volume or with a volume scale printed on its side that indicates the approximate volume of a desired liquid, such as water, consumed or remaining in the bottle. The bottle includes a neck with external threads and a top opening. In the first embodiment, the bottle includes a threaded wide neck with an internally threaded, intermediate cap attached thereto. The intermediate cap includes a narrow, longitudinally aligned spout with external threads formed thereon and a top opening.

Attached to the spout's external threads, or to the external threads on the bottle's neck when the intermediate cap in not used, is an internally threaded lid with a bottle consumption turn dial attached thereupon. The turn dial fits inside a first recessed cavity formed on the top surface of the lid body. Disposed inside the recessed cavity is a snap ring that includes at least one side arm and a curved groove. The turn dial includes a circular base with a second recessed cavity with a serrated edge formed on its lower surface. Formed on the second recessed cavity is a downward extending tang that engages the curved groove on the snap ring when the turn dial is aligned and registered over the first recessed cavity. When the tang and groove are engaged, a side arm on the snap ring extends laterally and presses against the inside, serrated edge of the second recessed cavity formed on the circular base. During use, the user manually turns an upward extending handle on the turn dial and locks the turn dial so that its tip points towards one of a plurality of numerical or alphabetical indicia printed or formed into the shoulder area on the lid body. The snap ring is made of strong yet flexible material that provides sufficient force such that the turn dial cannot be accidentally rotated during normal use conditions.

In the preferred embodiment, an optional screen is provided between the intermediate cap and the bottle neck or between the lid and the bottle neck to prevent particular matter, such as ice or un-dissolved solute material added to the liquid from being consumed. Also, an optional tether line is provided between the neck of the bottle and the lid to keep the lid from being separated from the bottle.

In the preferred embodiment, the intermediate cap and lid are sold as a kit with a refillable bottle designed to hold approximately 16 to 34 fluid ounces of a desired liquid. Formed on the shoulder of the lid are sequential numbers that indicate the total number of bottles consumed during a 24 hour period. After the liquid in the bottle has been consumed or after the bottle has been refilled, the turn dial is rotated to the next number. It should be understood however, that the intermediate cap or lid may be sold as separate components from the bottle thereby enabling them to be used with either a standard, reusable or disposable water bottle with a compatible threaded neck.

DESCRIPTION OF THE PREFERRED EMBODIMENT(S)

Figure 1:
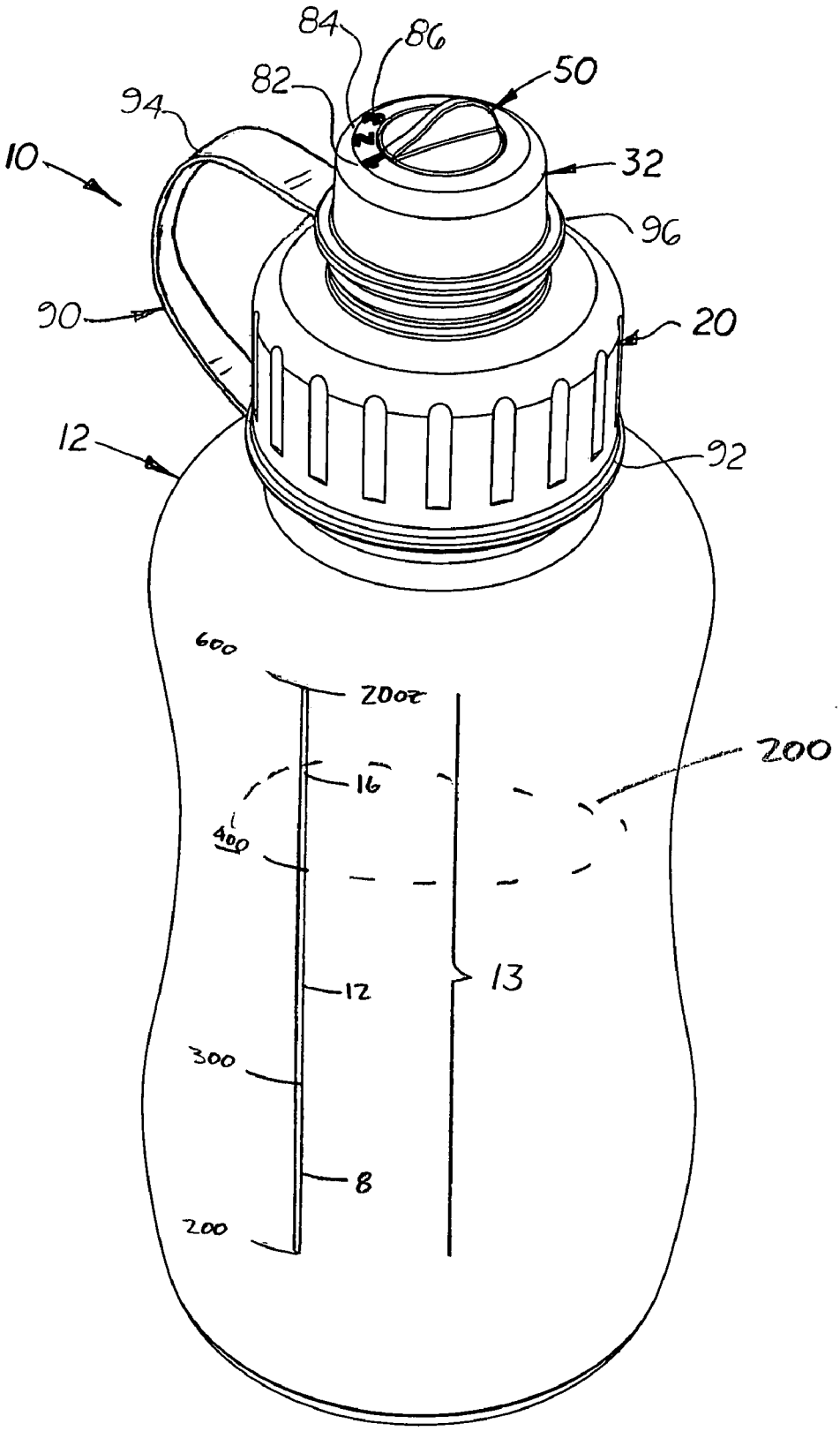
FIG. 1 is a top perspective view of the liquid consumption system disclosed herein.

Referring to the accompanying F*igs*. 1-12, there is shown a liquid consumption system designed 10 that includes a transparent or semi-opaque bottle 12 with an optional approximate volume scale 13 printed on one surface that indicates the volume of liquid 200 remaining in the water bottle 12.

In the first embodiment, the bottle 12 includes a wide neck 14 with external threads and a top opening 16. As shown in FIGS. 2-6, attached to the wide neck 14 is an intermediate cap 20 that includes a lower cap body 22 with internal threads 24 that selectively connects to the external threads 15 on the wide neck 14. The lower cap body 22 includes a cylindrical wall 25 and an upward extending, narrow, longitudinally aligned spout 26 with external threads 27 formed thereon. Formed on the end of the spout 26 is a top opening 28.

Located inside the bottom cavity 23 of the cap body 22 is an optional screen 95 designed to prevent particular matter, such as ice or un-dissolved solute material from being transmitted through the top opening 28.

Figure 7:
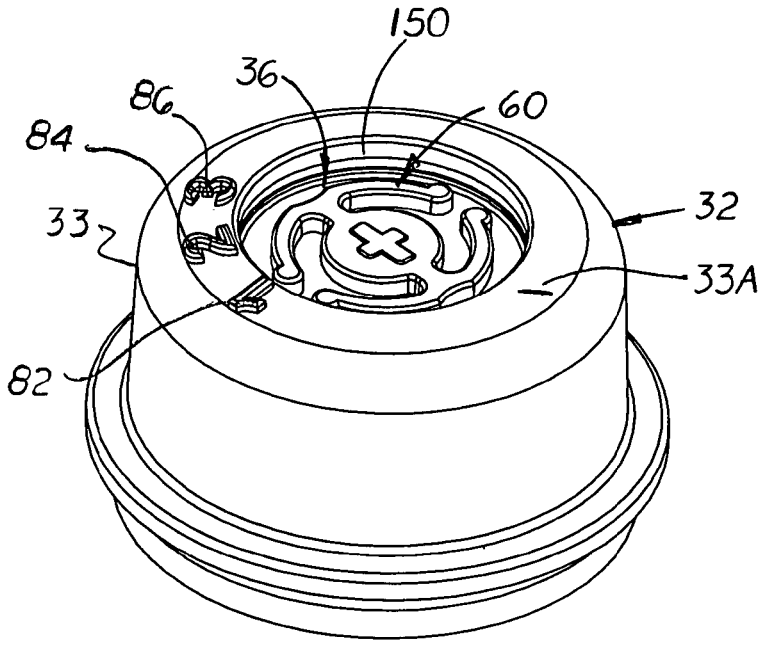
FIG. 7 is a top perspective view of the lid showing the snap ring inserted into the first recessed cavity and showing the turn dial removed.
Figure 8:
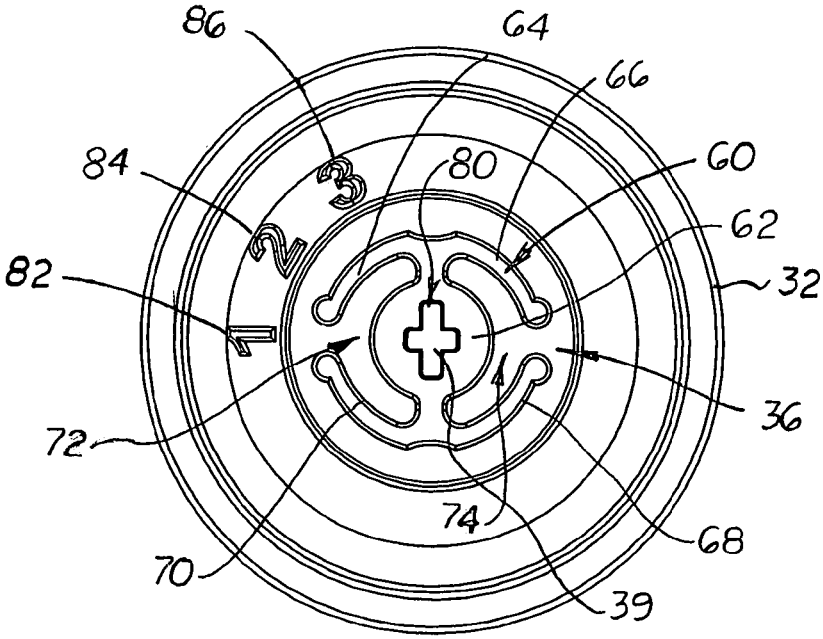
FIG. 8 is a top plan view of the lid shown in FIG. 7.

Attached to the external threads 27 on the spout 26 is a threaded lid 32. The lid 32 includes a cylindrical lid body 33 with internal threads 34 designed to connect to the threads formed on the spout 26. Attached to the lid body 33 is a rotating turn dial 50. The turn dial 50 fits inside a first recessed cavity 36 formed on the top surface of the lid body 33 (shown more clearly in FIG. 7). Disposed centrally in the first recessed cavity 36 is a flexible snap ring 60 that enables the turn dial 50 to be manually turned and temporarily locked into one of a plurality of positions and not be accidentally moved out of any of those positions by normal everyday use.

Figure 9:
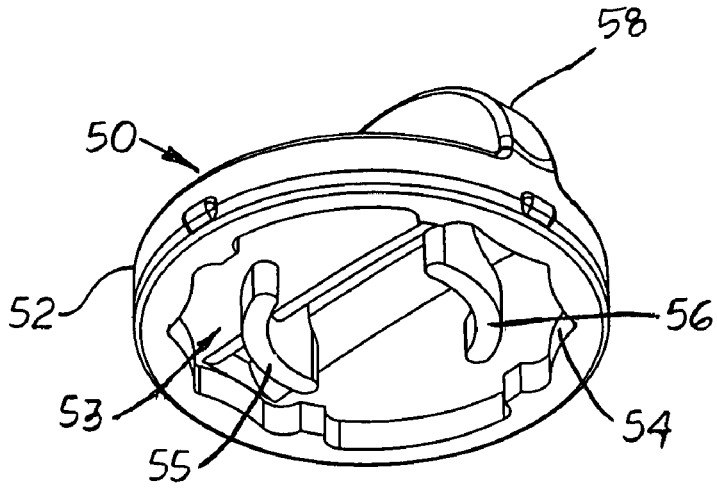
FIG. 9 is a bottom perspective view of the turn dial.
Figure 10:
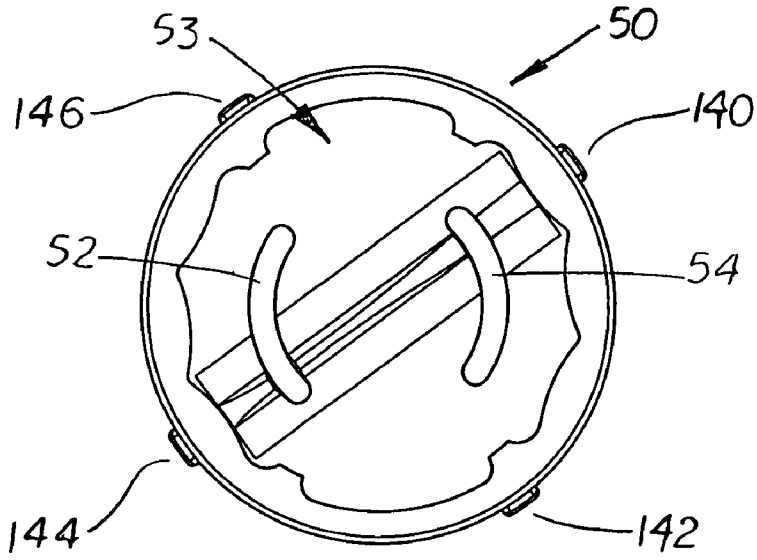
FIG. 10 is a bottom plan view of the turn dial.

As shown in FIG. 9, the turn dial 50 includes a circular disc 52 with a turn handle 58 perpendicularly mounted or formed thereon. Formed on the bottom of the circular disc 52 is a second recessed cavity 53. The inside edge 54 of the second recessed cavity 53 is serrated. Formed on the outer edge of the turn dial 50 are four nodes, 140, 142, 144, 146. The nodes 140, 142, 144, 146, are equally spaced apart around the circular disc 52. The nodes 140, 142, 144, 146 are designed to snap-fit into a circular groove 150 formed on the vertical side wall of the first recessed cavity to securely hold the turn dial 50 onto the cylindrical body 33.

Referring to FIGS. 7-10, the snap ring 60 includes a central plate 62 with four outward extending arms 64, 66, 68, and 70. Formed around the central plate 62 are two curved slots 72, 74. Formed on the central plate 62 is a '+' or cross-shaped cut-out 80 designed to receive a complimentary-shaped peg 39 formed centrally on the first recessed cavity 36. Formed on the bottom surface of the turn dial 50 are two curved tangs 55, 56 located on opposite sides of the center axis of the circular disc 52 that extend into the two curved slots 72, 74 formed on the snap ring 60 when the turn dial 50 is aligned and registered over the first recessed cavity Formed on the turn dial 50 is an upward extending handle 58 that is aligned with the tangs 55, 56 so that when the tangs 55, 56 are properly inserted into the two curved slots 72, 74, respectively, the ends of the arms 64-70 contact the serrated edge 54 formed on the turn dial 50 and the forward tip of the handle 58 points to one of the three bottle number indicators 82, 84, 86 formed on the shoulder area 33A on the lid body 33 surrounding the first recessed cavity 36.

In the first embodiment, the three bottle number indicators 82, 84, 86 are radially arranged approximately 15° degrees apart on the shoulder area 33A of the lid body 33. It should be understood that the invention is not limited to a bottle number indicator on the lid body 33 and that a letter (e.g. A, B, C) or a volume indicator (16 oz., 500 ml.) could be used in place thereof. The serrated edge 54 formed on the second recessed cavity 53 in conjunction with the snap ring 60, help to temporarily hold at a set position on the lid body 33 so that the tip of the handle 58 points at the bottle number indicator 82, 84, 86 until forcibly moved by the user.

Figure 2:
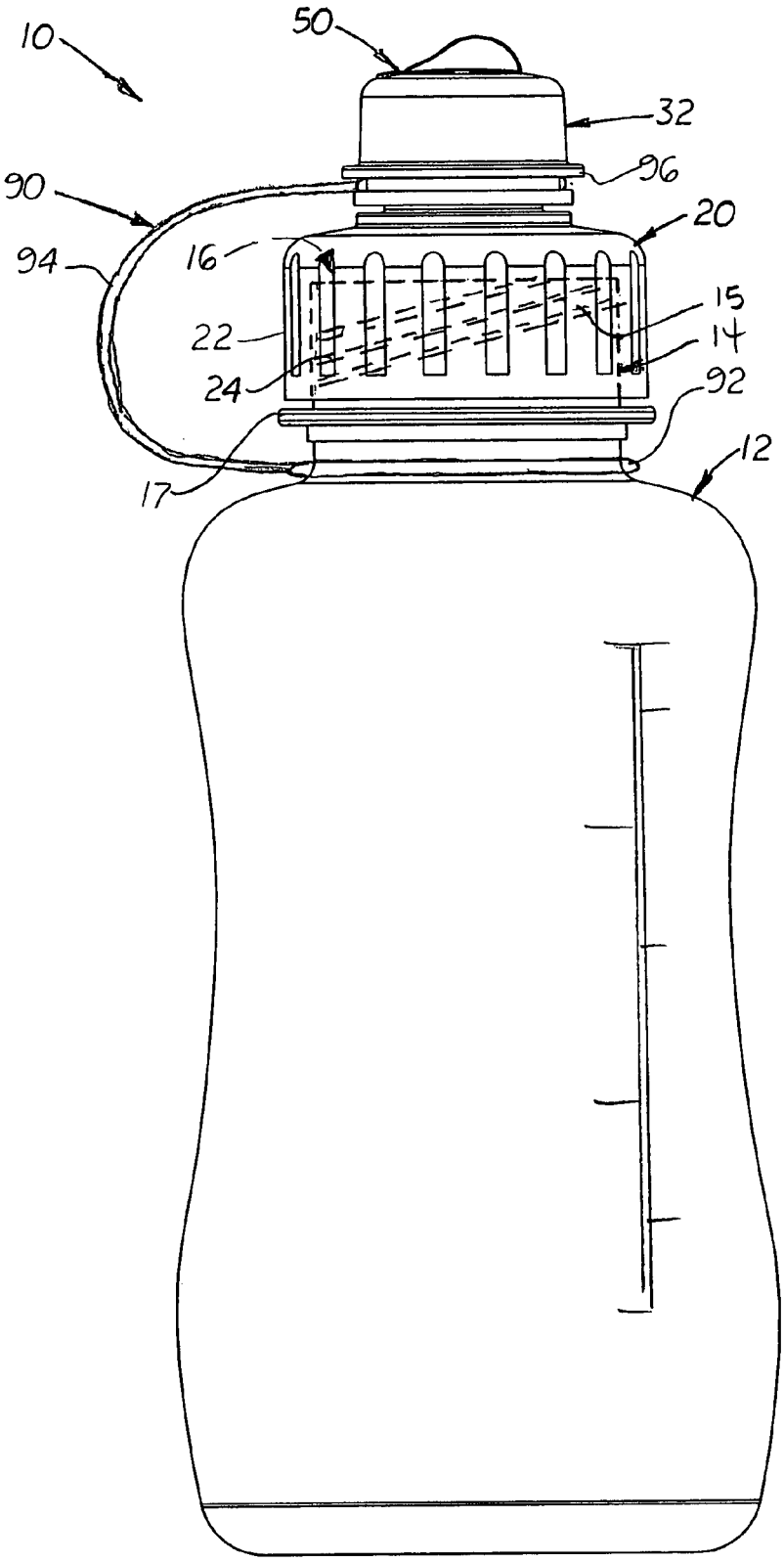
FIG. 2 is a side elevational view of the liquid consumption system shown in FIG. 1.
Figure 3:
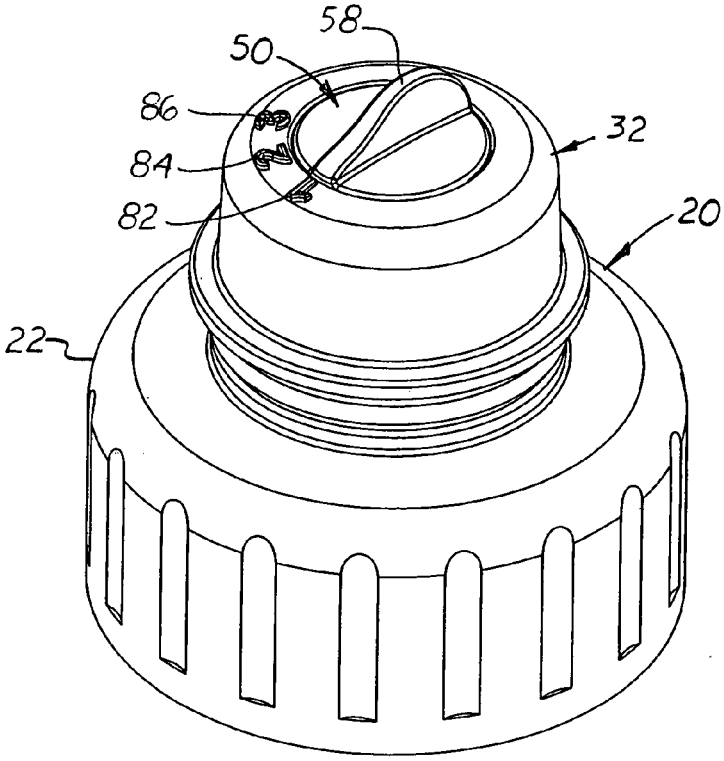
FIG. 3 is a top perspective view of the intermediate cap and lid.
Figure 4:
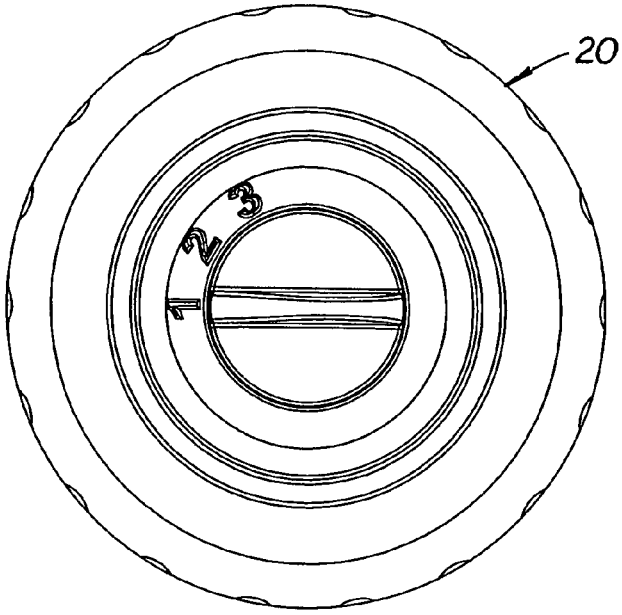
FIG. 4 is a top plan view of the intermediate cap and lid.
Figure 5:
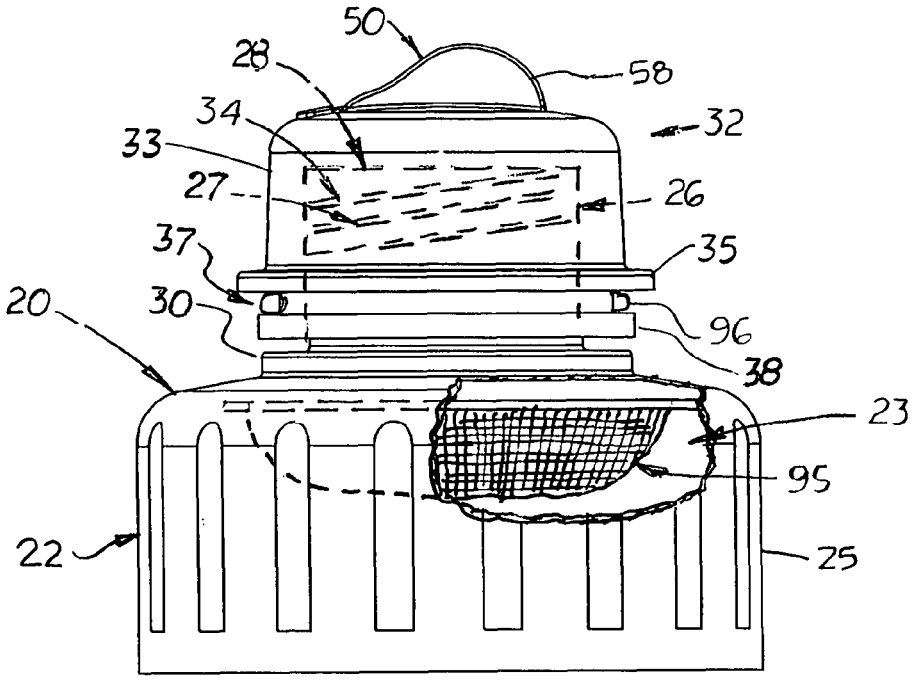
FIG. 5 is a side elevational view of the intermediate cap with a screen and lid.
Figure 6:
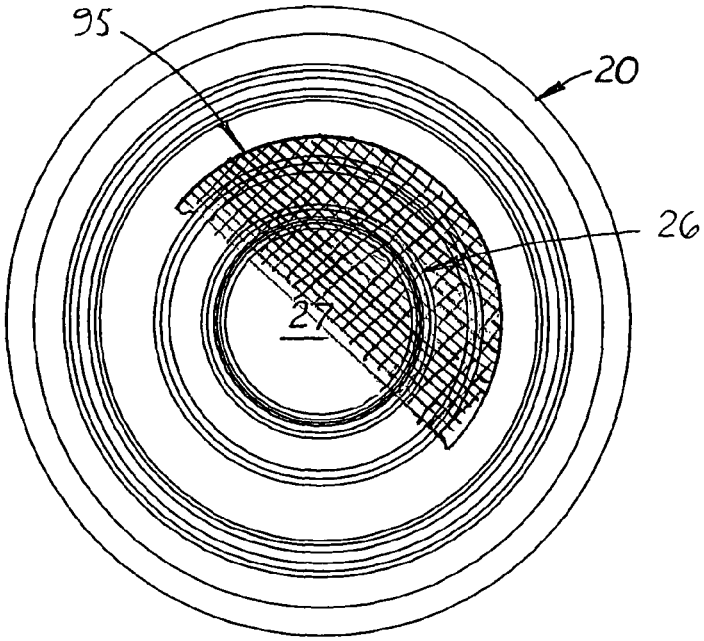
FIG. 6 is a bottom plan view of the intermediate cap with the screen partially removed.

Referring to FIGS. 1 and 2 an optional tether line 90 is disposed between the neck 14 of the bottle 12 and the lid 32. In the preferred embodiment, the bottle 12 includes a lower neck ring 17 formed on the lower section of the neck 14. The tether line 90 includes a lower ring 92, a plastic strap 94 and an upper ring 96. The lower ring 92 extends around the neck and under the lower neck ring 17 to securely attach the tether line 90 to the neck 14. The upper ring 96 extends around the lid 32. Referring to FIG. 5, in the preferred embodiment, the lid 32 includes an upper stop ring 35 and a lower stop ring 38. During assembly, the upper ring 96 on the tether line 90 is disposed in the narrow space 37 created between the upper stop ring 35 and the lower stop ring 38 where it can rotate freely therearound the neck 14. The strap 94 is approximately 4 inches in length.

Figure 11:
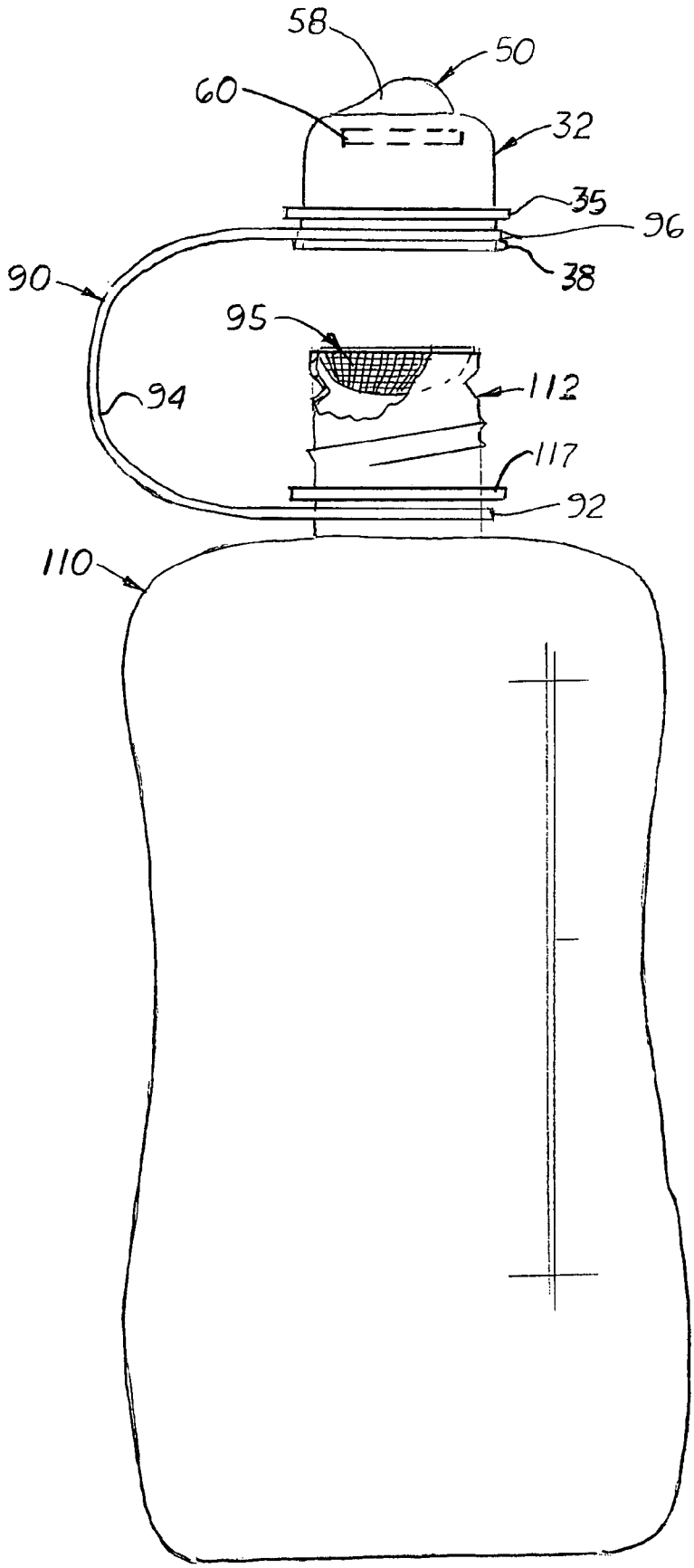
FIG. 11 is a side elevational view of a reusable bottle with a narrower neck designed to receive a tethered lid, but no intermediate cap, with a screen placed over the neck opening.

In a second embodiment of the invention, shown in FIG. 11, only the lid 32 is used with a re-useable bottle 110 with a narrow threaded neck 112, designed to attach directly to the lid 32. The lid 32 includes the lid body 33, the snap ring 60, the turn dial 50, the handle 58, and the tether line 90. An optional screen 95 may be pressed into the place located just below and inside the top opening of the neck 112 and held in position by a contact fit or by the lid 32 when connected to the neck 112.

Figure 12:
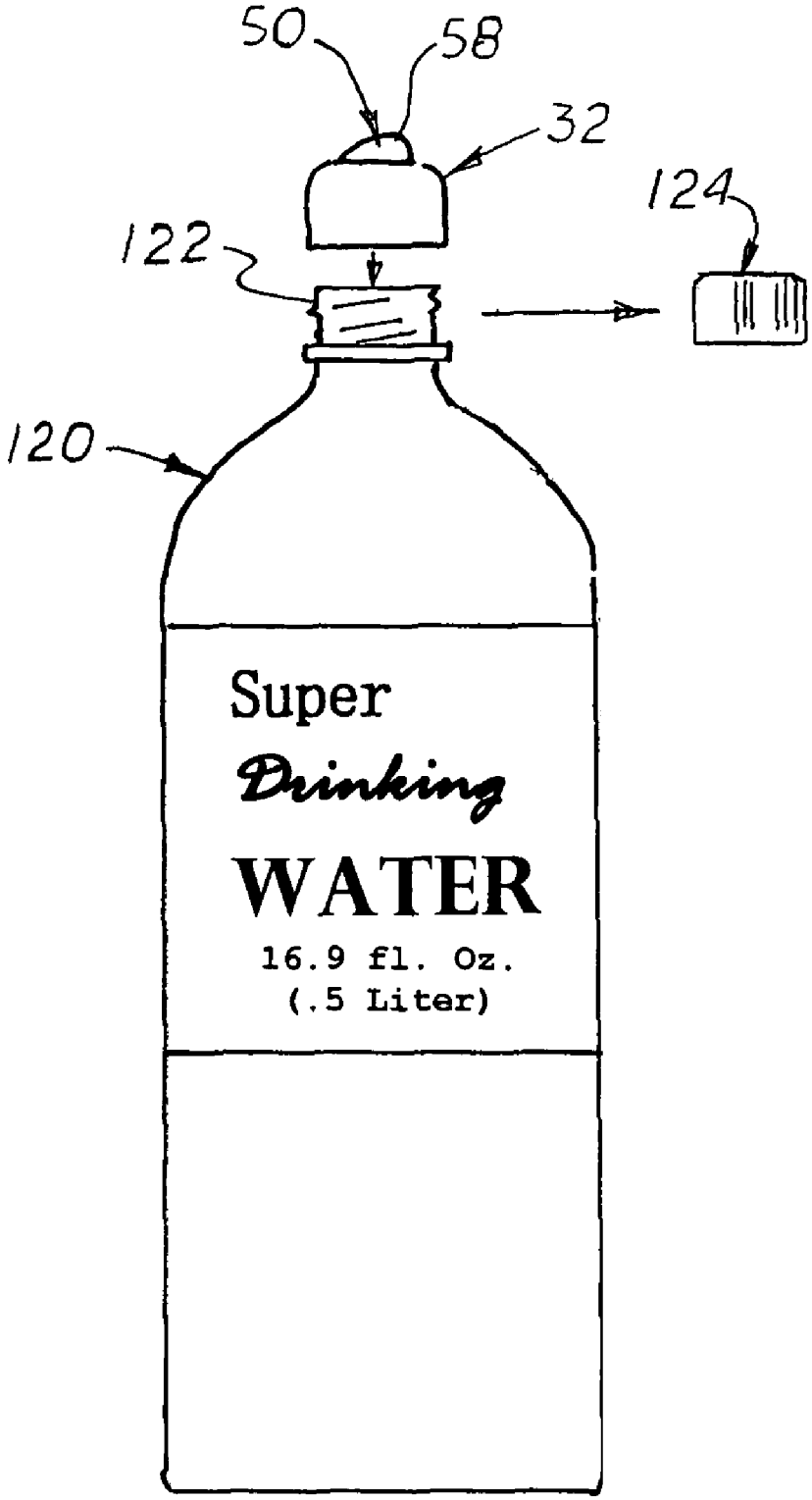
FIG. 12 is a side elevational view of a standard disposable water bottle with a neck designed to receive the lid disclosed herein.

In a third embodiment of the invention, shown in FIG. 12, the lid 32 is designed to be used with a disposable bottle 120 with a narrow threaded neck 122. The lid 32 is designed to replace the standard cap 124 attached to the bottle 120 when sold. During use, the standard cap 124 is replaced by the lid 32 prior the use. The user moves the handle 58 on the turn dial 50 to the next highest number each time the volume of water in the bottle 120 is consumed.

In the preferred embodiment, the bottles 12, 110 measure approximately 3-½ inches in diameter, 8 inches in height and holds approximately 16 to 34 fluid ounces. The neck 14 measures 2 inches in diameter and is approximately 1-¼ inches in length. The bottle neck 112 measures approximately ⅞ in diameter and 1 inch in height. The lower neck rings 17 and 117 formed on the lower part of necks 14 and 112 measures approximately ¼ approximately ¼ inch greater in diameter than the adjacent necks 14, 112, respectively.

The lower cap body 22 section of the intermediate cap 20 is approximately 2-⅜ inches in diameter and approximately 1 inch in height. The intermediate cap's spout 26 is approximately ⅞ inches in diameter and ⅞ inches in height.

The lid body 33 is approximately 1-¼ inches in diameter and ¾ inch in height. The turn dial's handle 58 extends approximately ¼ inch above the lid body's shoulder area. The upper stop ring 35 measures approximately 1-½ inches in diameter while the lower stop ring measures approximately 1-⅜ inches in diameter. The lid body 33 is a molded structure with three sequential numbers (1, 2, 3) formed on the shoulder area.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A daily water consumption system for a water bottle with a threaded neck, comprising:

a. an intermediate cap with a wide lower body with internal threads that selectively connect to the threaded neck on a water bottle, said intermediate cap including an upward, extending longitudinally aligned narrow spout on said lower body with external threads formed thereon;

b. a lid with internal threads capable of connecting to said external threads on said spout, said lid includes a lower lid body with a first recessed cavity and a rotating turn dial disposed over said first recessed cavity;

c. a snap ring disposed inside said first recessed cavity and disposed between said lid body and said turn dial when said turn dial is aligned and registered over said lid body, said snap ring being used to temporarily lock said turn dial in a set position on said lid when said turn dial is rotated on said lid body; and, d. a bottle consumption indicia aligned on the external surface of said lid body and adjacent to turn dial when attached to said lid body, said bottle consumption indicia indicates the number of times a water bottle is filled within a designated time period.

2. The daily water consumption system, as recited in claim 1, wherein said lid body includes an upward extending peg that fits into a complimentary-shaped cutout formed on said snap ring to hold said snap ring in a fixed position inside said first recessed cavity in said lid body.

3. The daily water consumption system, as recited in claim 2 further including a tether line connected at its opposite ends to said neck on said bottle and said lid body.

4. The daily water consumption system, as recited in claim 2, wherein said turn dial is temporarily locked in a set position of said lid body by said snap ring disposed inside a first recessed cavity formed on said lid body, said turn dial capable of engaging said snap ring so that when said turn dial is manually rotated to point to said bottle consumption indicia on said lid body, further rotation of said turn dial on said lid body is partially resisted.

5. The daily water consumption system, as recited in claim 1, further including a screen attached to said intermediate cap lid for filtering water through said intermediate cap.

6. A daily water consumption indicator lid, comprising:

a. a cylindrical lid body with internal threads with a bottle consumption indicia formed or printed on an external surface, said lid body including a first recessed cavity formed on said top surface, and a lower threaded cavity;

b. a snap ring disposed inside said first recessed cavity on said cylindrical body, said snap ring including at least two laterally extending curved arms and at least one slot opening formed there between, and, c. a turn dial disposed over said first recessed cavity and said snap ring, said turn dial including a second recessed cavity with a serrated circular perimeter edge, said turn dial including at least one tang capable of engaging said slot opening on said snap ring when said turn dial is aligned and registered over said first recessed cavity, whereby when said turn dial is rotated over said first recessed cavity, said curved arms are forced outward and press against said serrated perimeter edge on said turn dial to temporarily lock said turn dial in fixed position on said cylindrical lid body and point towards said bottle consumption indicia formed or printed on said cylindrical lid body.

7. The daily water consumption indicator lid, as recited in claim 6, wherein said snap ring is disposed inside a first recessed cavity formed on said lid body and said turn dial engages said snap ring, whereby when said turn dial is manually rotated to point to said bottle consumption indicia on said lid body, further rotation of said turn dial on said lid body is partially resisted.

8. The daily water consumption indicator lid, as recited in claim 6, wherein said lid body includes an upward extending peg that fits into a complimentary-shaped cutout formed on said snap ring to hold said snap ring in a fixed position inside said first recessed cavity in said lid body.

9. The daily water consumption indicator lid, as recited in claim 6, further including at least two nodes formed on said turn dial and a circular groove formed on said first recessed cavity in said lid body, said nodes engaging said circular groove to rotatably mount said turn dial on said lid body.

* * * * *